US005283747A

United States Patent [19]

Komuro et al.

[11] Patent Number: 5,283,747

[45] Date of Patent: * Feb. 1, 1994

[54] EMBROIDERY PATTERN DATA PROCESSOR

[75] Inventors: Kyozi Komuro; Atsuya Hayakawa; Hideaki Shimizu, all of Nagoya, Japan

[73] Assignee: Brother Kogyo Kabushiki Kaisha, Nagoya, Japan

[ * ] Notice: The portion of the term of this patent subsequent to Sep. 29, 2009 has been disclaimed.

[21] Appl. No.: 539,207

[22] Filed: Jun. 18, 1990

[30] Foreign Application Priority Data

Jun. 28, 1989 [JP] Japan ..... 1-167875

[51] Int. Cl.[5] ..... G06F 15/46

[52] U.S. Cl. ..... 364/470; 112/121.12

[58] Field of Search ..... 364/470; 112/103, 2, 112/102, 457, 456, 121.12, 121.11, 454

[56] References Cited

U.S. PATENT DOCUMENTS 4,526,116 7/1985 Männel ..... 112/103
4,849,902 7/1989 Yokoe et al. .
4,960,061 10/1990 Tajima et al. ..... 112/103
4,964,352 10/1990 Yokoe et al. ..... 112/103
4,982,674 1/1991 Hayakawa ..... 364/470
4,991,524 2/1991 Ozaki ..... 112/103
5,151,863 11/1992 Komuro et al. ..... 364/470

*Primary Examiner*—Jerry Smith
*Assistant Examiner*—Jim Trammell
*Attorney, Agent, or Firm*—Oliff & Berridge

[57] ABSTRACT

An embroidery pattern data processor for sewing an embroidery based on section data representing the locations of the vertexes of polygonal sections dividing a closed area surrounded by a given outline for embroidering the closed area. The data processor has a memory for storing the section data, a read-out device for reading out the section data, and a processor for determining the type of sections, computing running stitch data, and computing needle location data for embroidering the sections. Additionally, the processor automatically computes a running stitch route within the sections so that the embroidering operation is carried out without producing cross threads which, in the past, had to be manually removed.

19 Claims, 12 Drawing Sheets

FIG. 6

| MEMORY ORDER | SECT. | SECT. DATA |
|---|---|---|
| 1 | a | POINTS 1, 2<br>POINTS 3, 4 |
| 2 | b | POINTS 3, 4<br>POINTS 5, 6 |
| 3 | c | POINTS 5, 6<br>POINTS 7, 8 |
| 4 | d | POINTS 7, 8<br>POINTS 9, 10 |
| 5 | e | POINTS 9, 10<br>POINTS 11, 12 |
| 6 | f | POINTS 11, 12<br>POINTS 13, 14 |
| 7 | g | POINTS 15, 16<br>POINTS 17, 18 |
| 8 | h | POINTS 17, 18<br>POINTS 19, 20 |
| 9 | i | POINTS 19, 20<br>POINTS 21, 22 |
| 10 | j | POINTS 21, 22<br>POINTS 23, 24 |
| 11 | k | POINTS 23, 24<br>POINTS 6, 8 |
| 12 | l | POINTS 5, 7<br>POINTS 25, 26 |
| 13 | m | POINTS 22, 24<br>POINTS 27, 28 |
| 14 | n | POINTS 27, 28<br>POINTS 29, 30 |
| 15 | o | POINTS 29, 30<br>POINTS 31, 32 |
| 16 | p | POINTS 31, 32<br>POINTS 33, 34 |
| 17 | q | POINTS 33, 34<br>POINTS 35, 36 |

FIG. 7

| MEMORY ORDER | SECT. | ADJA-CENT SECT. | BORDER DATA | BORDER DATA ERASE FLAG | PROC-ESSED SECT. FLAG | FORK SECT. FLAG | END SECT. FLAG |
|---|---|---|---|---|---|---|---|
| 1 | a | b | POINTS 3, 4 | 1 | 1 | | 1 |
| 2 | b | a | POINTS 3, 4 | 1 | | | |
| | | c | POINTS 5, 6 | | | | |
| 3 | c | b | POINTS 5, 6 | | | | |
| | | l | POINTS 5, 7 | 1 | | 1 | |
| | | k | POINTS 6, 8 | | | | |
| | | d | POINTS 7, 8 | 1 | | | |
| 4 | d | c | POINTS 7, 8 | 1 | | | |
| | | e | POINTS 9, 10 | 1 | 1 | | |
| 5 | e | d | POINTS 9, 10 | 1 | | | |
| | | f | POINTS 11, 12 | 1 | 1 | | |
| 6 | f | e | POINTS 11, 12 | 1 | 1 | | 1 |
| 7 | g | h | POINTS 17, 18 | | | | 1 |
| 8 | h | g | POINTS 17, 18 | | | | |
| | | i | POINTS 19, 20 | | | | |

FIG. 7 (continued)

| | | | | | | | |
|---|---|---|---|---|---|---|---|
| 9 | i | h | POINTS 19, 20 | | | | |
| | | j | POINTS 21, 22 | | | | |
| 10 | j | i | POINTS 21, 22 | | | | |
| | | m | POINTS 22, 24 | | | 1 | |
| | | k | POINTS 23, 24 | | | | |
| 11 | k | j | POINTS 23, 24 | | | | |
| | | c | POINTS 6, 8 | | | | |
| 12 | l | c | POINTS 5, 7 | | | | 1 |
| 13 | m | j | POINTS 22, 24 | | | | |
| | | n | POINTS 27, 28 | | | | |
| 14 | n | m | POINTS 27, 28 | | | | |
| | | o | POINTS 29, 30 | | | | |
| 15 | o | n | POINTS 29, 30 | | | | |
| | | p | POINTS 31, 32 | | | | |
| 16 | p | o | POINTS 31, 32 | | | | |
| | | q | POINTS 33, 34 | | | | |
| 17 | q | p | POINTS 33, 34 | | | | 1 |

EMBROIDERY PATTERN DATA PROCESSOR

BACKGROUND OF THE INVENTION

1. Field of the invention

The present invention relates to an embroidery pattern data processor that computes needle locations for sewing each of the sections dividing an embroidery based on section data for designating the locations of the vertexes of the polygonal sections dividing a closed area of a given shape, where the embroidery is defined and surrounded by an outline.

2. Prior Art

An embroidery pattern data processor of this kind has been disclosed in U.S. Pat. No. 4,849,902.

The conventional technique of processing such data has included the steps of displaying a drawing of embroidery filmed by a television camera or the like on a CRT display unit, storing an outline defining the embroidery in a memory by designating points on the outline with a light pen with the displayed image of the embroidery for reference, drawing dividing lines inside the closed area in any order for dividing the closed area into a plurality of polygonal sections, hence successively defining sections having the designated points as their vertexes, and storing the location data for the vertexes as section data. Then, as well known in the art, the data for needle locations is computed based on section data successively read out and predetermined stitch density data. Embroidery is formed on a cloth by moving the needle and the cloth by relative displacement based on the obtained data for needle locations.

As explained above, the actual embroidering is carried out in accordance with the order in which the section data previously stored in the memory are read out. Therefore, if only section data is stored in the memory, cross threads may occur depending on the order in which the section data are stored. In such cases, it is necessary for the operator to remove all the cross threads after embroidering in order to enhance the esthetic value of the embroidery. Removing cross threads is tedious and labor intensive.

Previously, in order to prevent cross threads from occurring, the operator would anticipate the sewing order in which cross threads do not occur before the step where the operator divides a closed area into a plurality of sections for embroidering the closed area surrounded by a given outline. The operator also prepared section data in accordance with the sewing order. If one section is located separately from the previous section for which the section data has just been prepared, the data for needle locations to form running stitches which run within the sections to the top therethrough are successively prepared. At this point, the section data for sewing the section from the end of the running stitch to the start thereof is prepared. For instance, to form T-shaped embroidery as shown in FIG. 9, points P1 and P2 are first designated. Second, points P3 and P4 are designated so that a line segment $\overline{P3P4}$ divides the closed area S. Thirdly, the point P4, a point q, and a point 5 are designated for forming running stitches running from the point P4 to the point P5. The location data for the points P4, q, and P5 are stored as the running stitch data. Next, the section data for a section B2 is prepared by designating the point P5, a point P6, the point P3, and the point P4. Likewise, the point P4, a point P7, a point P8, and a point P9 are designated in preparation for the section data for a section B3.

As well known to those skilled in the art, the first two points P1, P2 are on the side where the embroidering starts while the latter two points P8, P9 are on the side where the embroidering ends. In other words, the running stitches process from the point P4 to the point P5, whereas the embroidering of the section B2 is carried out in the opposite direction from the point P5 to the point P4. This prevents passing threads from occurring.

As is clear from the foregoing explanation, the conventional apparatus necessitates the preparation of a section data and the running stitch data by the operator, which preparation is difficult, is time-consuming, and requires skill.

SUMMARY OF THE INVENTION

An object of the invention made to overcome the above-identified problems is to provide an embroidery pattern data processor which automatically prepares running stitch data and embroidering data without producing cross threads and without manual setting operations performed by the operator.

To attain this object, an embroidery pattern data processor of the present invention comprises: a memory means for storing section data representing the locations of the vertexes of polygonal sections dividing a closed area surrounded by a given outline for embroidering the closed area; a read-out means for successively reading out the section data corresponding to each of the given sections; a determination means for determining if a section corresponding to the section data read out by the read-out means is an end section of the main section column connected with the given sections, a fork section from which a branch section column branches out of a main section column, or an end section of a branch section column based on the read-out section data; a running stitch computing means for computing running stitch data representing the sewing route of running stitches which run from a fork section to the top of an end section of a branch section column or of a main section column prior to the embroidering of the fork section if a section corresponding to section data read out by the read-out means is a fork section; and a needle location computing means for computing needle location data for embroidering the sections in the opposite direction from the end of the running stitches toward the fork section based on the section data.

In operation, once section data is stored in the memory means, the read-out means successively reads out the section data corresponding to each of the given sections. Then, the determination means determines if a section corresponding to the section data read-out by the read-out means is an end section of the main section column connected with the given sections, a fork section from which a branch section column branches out of a main section column, or an end section of a branch section column based on the read-out section data. The running stitch computing means computes running stitch data representing the sewing route of running stitches which run from a fork section to the top of an end section of a branch section column or of a main section column prior to the embroidering of the fork section if a section corresponding to section data read out by the read-out means is a fork section. Subsequently, the needle location computing means computes needle location data for embroidering the sections in the opposite direction from the end of the running stitches toward the fork section based on the section data.

BRIEF DESCRIPTION OF THE DRAWINGS

FIG. 6 is a memory map describing the section data of the sections of the closed area E.

FIG. 7 is memory map describing the data of the relative positions of the sections of the closed area E.

DETAILED DESCRIPTION OF THE PREFERRED EMBODIMENT

Referring to the attached drawings, the invention embodied in a multi-needle embroidering machine is explained hereinafter.

Figure 2:
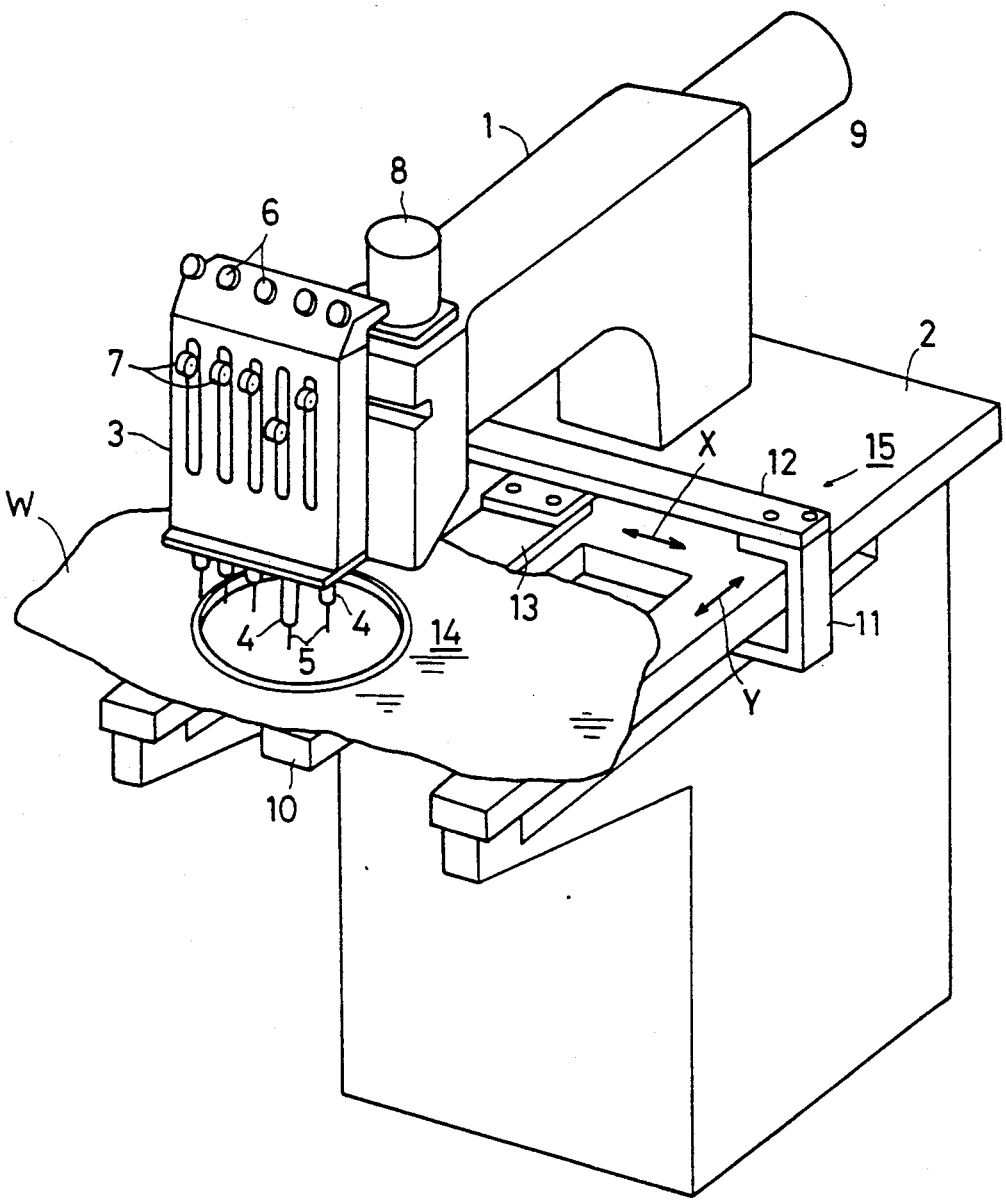
FIG. 2 is a perspective view of a multi-needle embroidery machine embodying the invention.
Figure 3A:
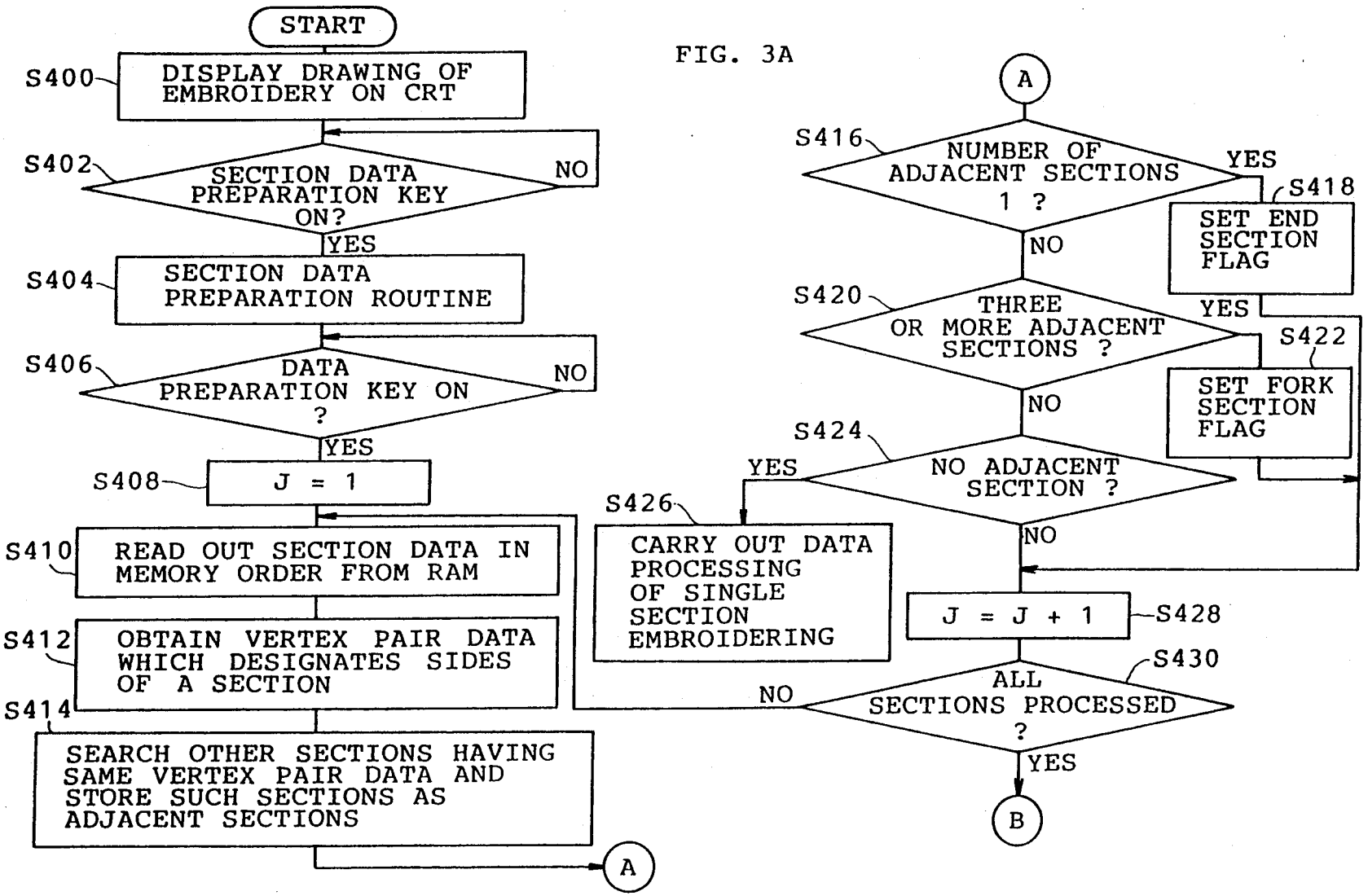
FIG. 3A, 3B, 3C, 3D, and 3E are flowcharts describing the main operations of the Central Processing Unit of the embodiment.
Figure 3B:
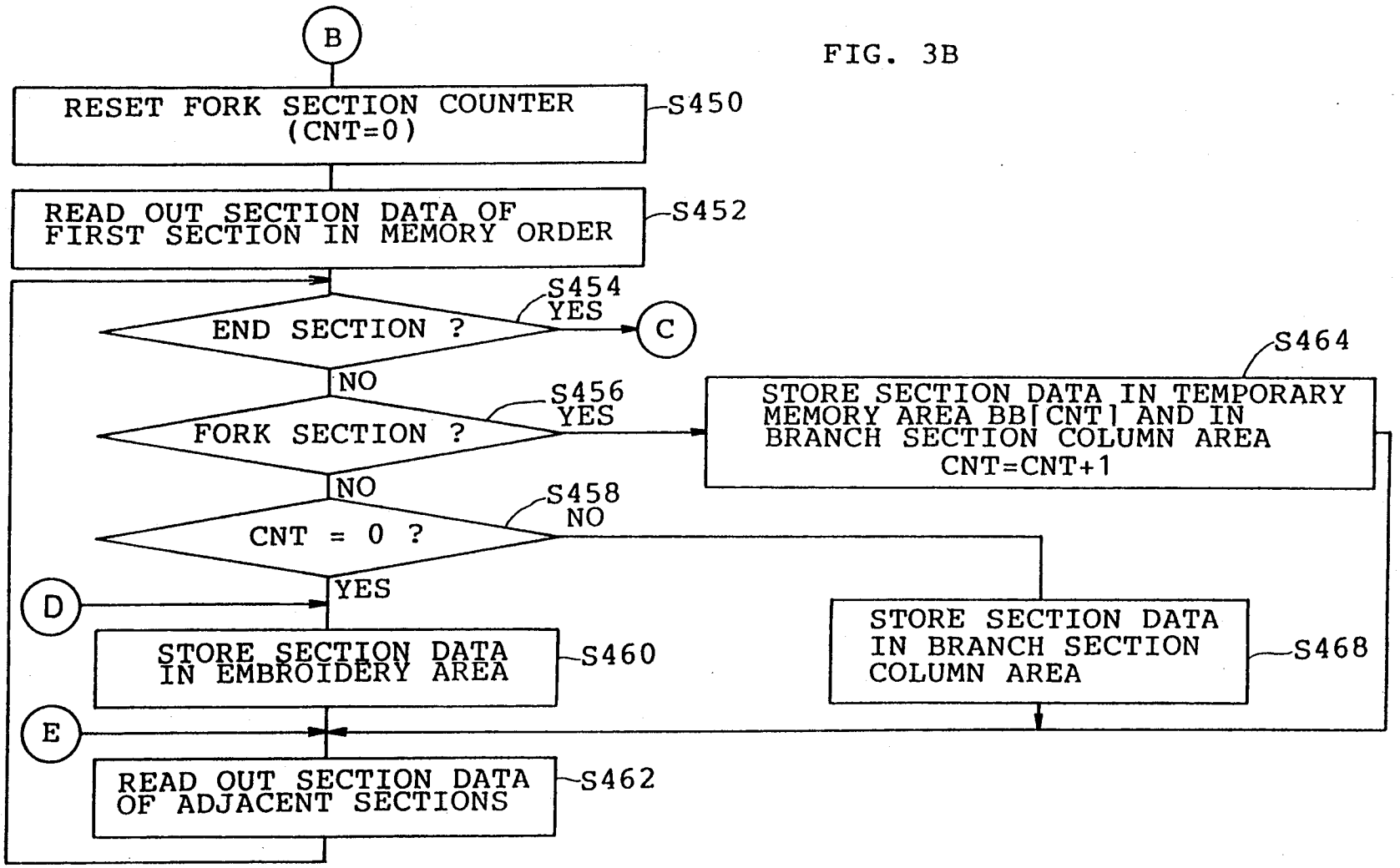
Figure 3C:
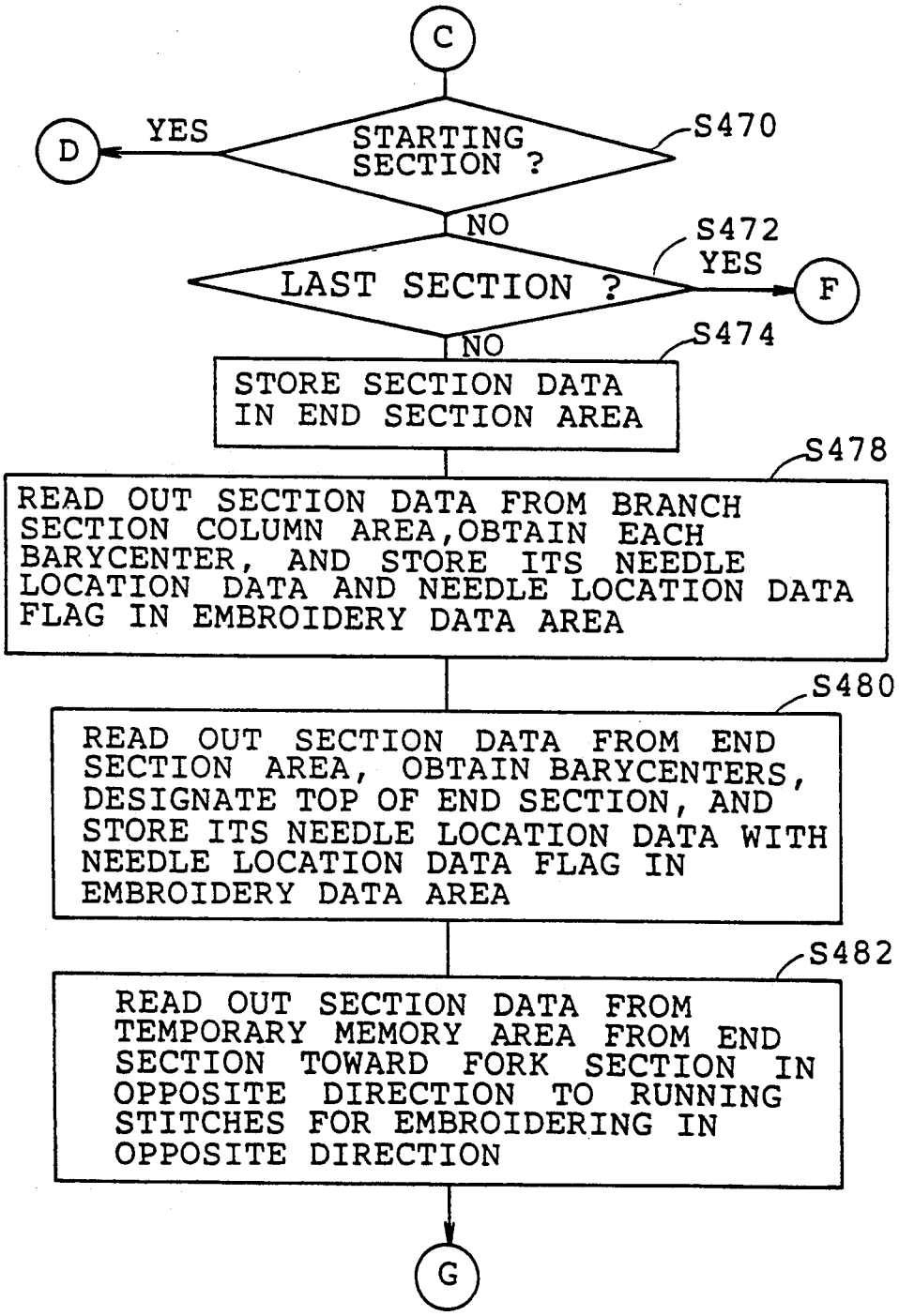
Figure 3D:
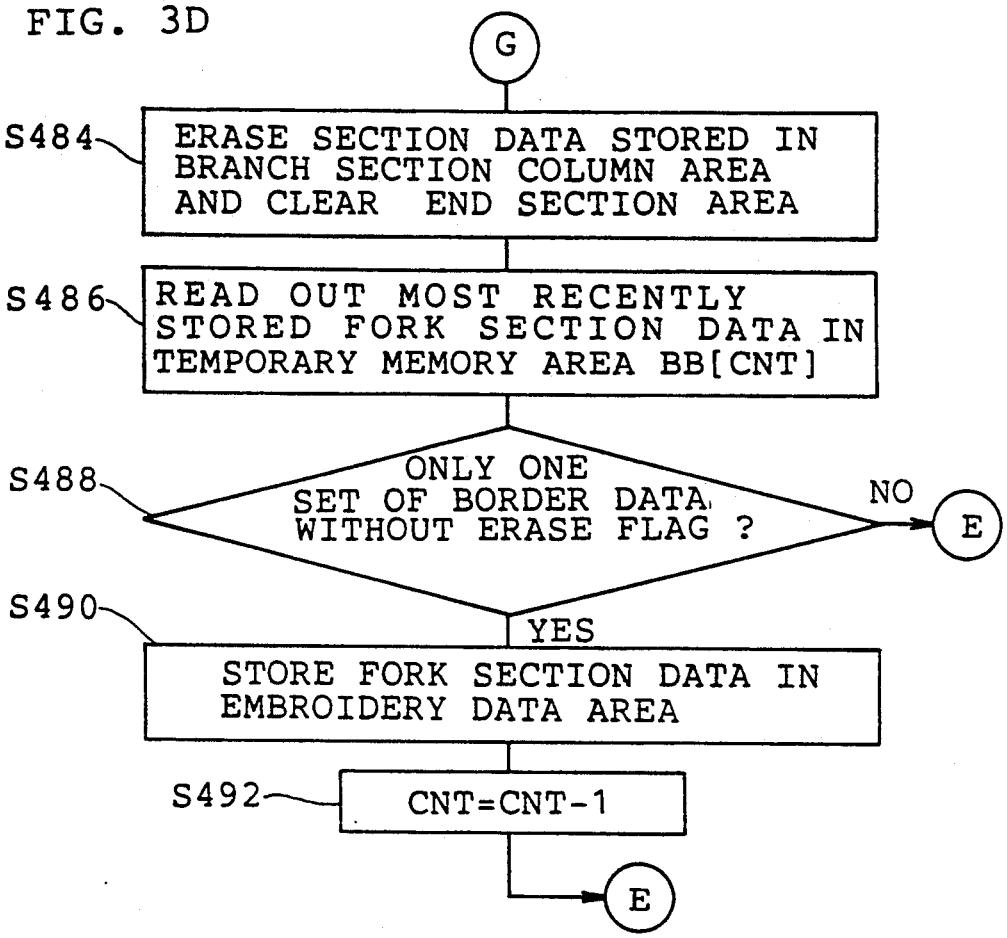
Figure 3E:
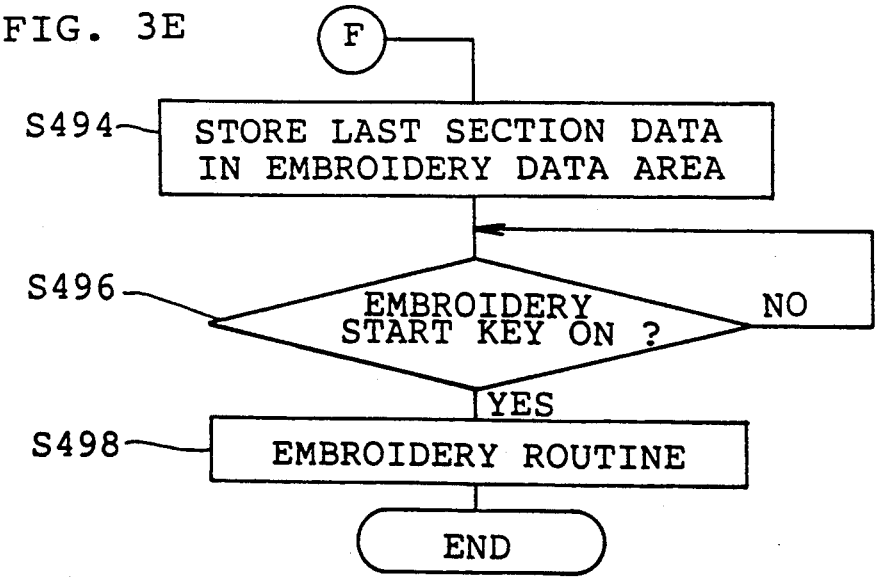

As illustrated in FIG. 2, an arm 1 is mounted on a table 2. A needle bar support case 3 is movably supported in the directions indicated by an arrow X on the top end of the arm 1. Four needle bars 4 are respectively supported by the needle bar support case 3 so that the needle bars 4 are vertically movable. Needles 5 are detachably mounted on the lower ends of each of the needle bar 4. Various types of threads are supplied to the needles 5 from a thread supply source (not shown) via thread tension adjusters 6 and thread take-up levers 7 provided on the needle bar support case 3. A needle selection motor 8 is provided on the arm 1 and is drivably connected to the needle bar support case 3. When a predetermined needle selection signal is input into the needle selection motor 8, the needle selection motor 8 moves the needle bar support case 3 to put one of the needles 5 in a designated position.

Provided at the rear of the arm 1 is a sewing motor 9 whose power is transmitted to the positioned needle bar 4 via a power transmission mechanism (not shown), thereby vertically moving the needle bar 4. A bed 10 projects from the table 2 and is positioned so that it is opposed to the needle bar 4. The bed 10 is provided with a loop capture device therein for forming stitches on a work W in cooperation with the needle 5. The needle 5, the loop capture device, and so forth compose a stitch forming means.

A pair of Y-direction movable frames 11 (referred to as first movable frames hereinafter) are provided at both sides of the table 2 so that the first movable frames 11 can slide in the directions indicated by an arrow Y. The first movable frames 11 are driven by a not-shown Y-direction drive motor (referred to as first drive motor hereinafter). FIG. 2 shows only one of the first movable frames 11. Further, the first movable frames 11 are connected with each other via a supporting beam 12 provided therebetween. The bottom end of a X-direction movable frame 13 (referred to as second movable frame hereinafter) is supported by the supporting beam 12 so that the second movable frame 13 can slide in the directions indicated by an arrow X along the supporting beam 12. The second movable frame 13 is driven by a not-shown X direction drive motor (referred to as second drive motor hereinafter). A support ring 14 provided as a support means is mounted on the second movable frame 13 for releasably supporting the work W.

The first and second movable frames 11 and 13, the support beam 12, and the first and second drive motors compose a feed device 15 for changing the relative position of the support ring 14 and the needle 5 in synchronization with the vertical motion of the needle 5. Stitches of embroidery are formed on the work W by the relative displacement movement of the support ring 14 and the needle 5.

The electrical composition of the embodiment is explained hereinafter.

Figure 1:
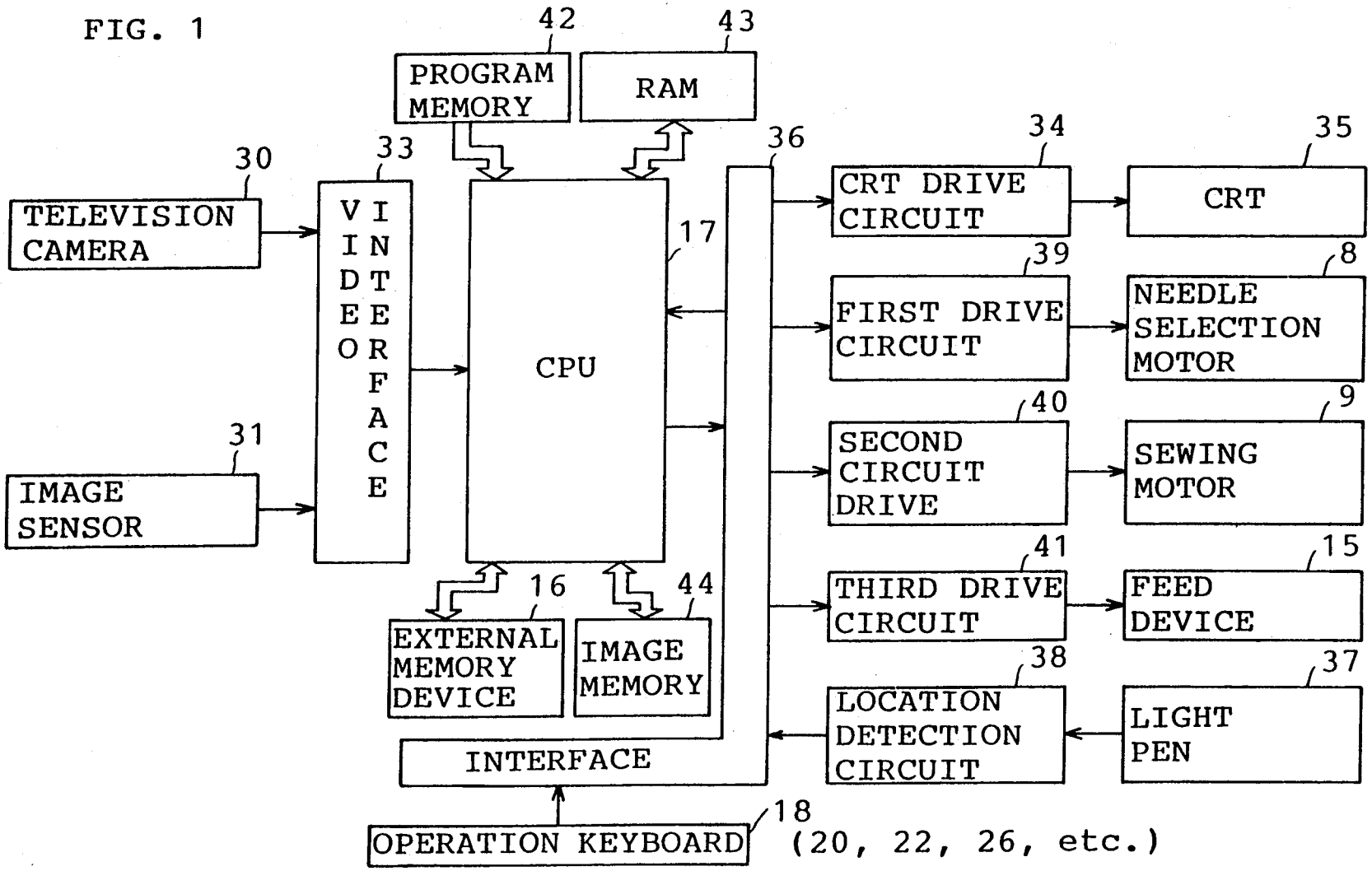
FIG. 1 is a block diagram of an electric circuit embodying the present invention.

As shown in FIG. 1, an operation keyboard 18 is connected to an interface 36 of a CPU 17. The operation keyboard 18 is provided with a data preparation key 20, a section data preparation key 22, an embroidering start key 26, and so forth. The needle selection motor 8, the sewing motor 9, and a feed device 15 are connected to the interface 36 via a first, second, and third drive circuits 39, 40, and 41, respectively. Further, a CRT 35 is connected to the interface 36 via a CRT drive circuit 34 while a light pen 37 is provided for designating given points on the display surface of the CRT 35 via a location detection circuit 38. The CPU 17 is connected with a television camera 30, for filming a drawing of an embroidery, and an image sensor 31 via a video interface 33. The CPU 17 is also connected with a program memory 42 which contains its motion programs, a RAM 43 chiefly composing a memory means for storing section data, an external memory device 16 for storing needle location data, and an image memory 44 for storing a drawing of the embroidery filmed by the television camera 30 or the like, or the location data of the points on the display surface of the CRT 37 designated by the light pen 37.

Figure 4:
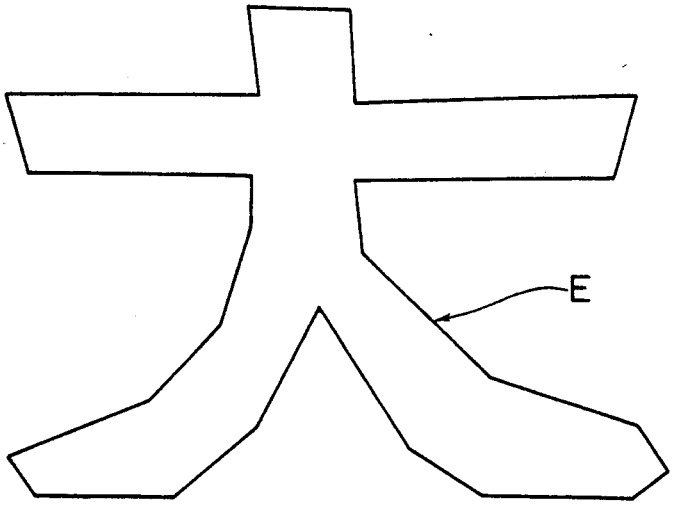
FIG. 4 is an closed area E of the embodiment.

The embroidery operation on a closed area E shown in FIG. 4 is explained, referring to the flowcharts shown in FIGS. 3A, 3B, 3C, 3D, and 3E. In this case, the inside of the closed area E is embroidered.

Figure 5:
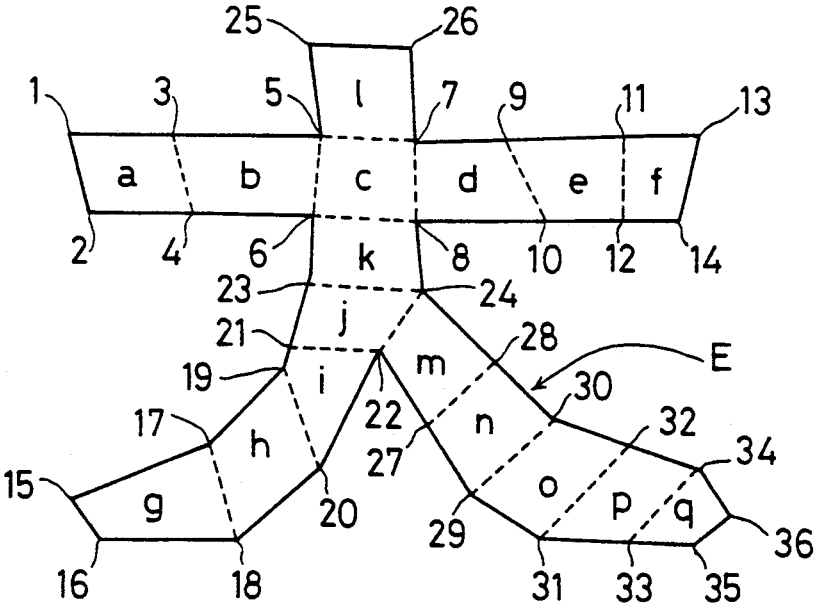
FIG. 5 is the closed area E divided into sections.

When the power supply is switched on after a drawing of the embroidery of the closed area E is set in the filming zone of the television camera 30 or the image sensor 31, the CPU 17 films and displays the drawing of the embroidery on the CRT 35 at step S400. When the section data preparation key 22 is switched on by the operator at step S402, the process steps go on to a section data preparation routine at step S404. In this routine, after the outline of the closed area E is stored using the light pen 37, dividing points for dividing the outline are successively designated by the light pen 37, hence dividing the closed area E into a plurality of polygonal sections. The dividing points represent the vertexes of the sections and the location data of the vertexes are stored in the RAM 43 as the section data for each section. The closed area E, for example, is divided into sections a–q as illustrated in FIG. 5 and the section data for each section is shown in the memory map in FIG. 6. Points 1–4 of the section a are stored in the numerical order, wherein the first two points 1 and 2 indicate the two vertex needle locations on the starting side of the section a. Therefore, the starting stitches are formed between points 1 and 2. Likewise, the latter two points, points 3 and 4, indicate the two vertex needle locations on the ending side of the section a. The ending stitches are formed between points 3 and 4.

The light-penned division of a closed area is not given detailed explanation herein since it is included in U.S. Pat. No. 4,849,902 in the name of the present applicant.

It should be noted, however, that the sections are stored in the RAM 43 in arbitrary order without considering an embroidering order of the sections. While all the sections shown in FIG. 5 are rectangular, triangles or other types of polygons will also suffice. A section may include arcs. If a section is a triangle or some other polygon wherein embroidering either starts or ends at one point, the data for the two vertexes representing such point is the same when stored. In case of a pentagon or other polygons having five or more vertexes, the data for designating the remaining sides, other than the above four points, is stored for each section.

After finishing the preparation of the section data, the CPU 17 waits for the data preparation key 20 to be switched on at step S406. When it is switched on, the CPU 17 reads out the section data for a section from the RAM 43 in the memory order J (J=1,2,3, . . . ) at step S410.

Based on the read out section data, the CPU 17 obtains the data for all the pairs of vertexes (referred to as vertex pair data hereinafter) which designates the sides of a section at step S412. For instance, the vertex pair data for the section a is pairs of points 1 and 2, points 3 and 4, points 1 and 3, and points 2 and 4.

Next, the CPU 17 searches the RAM 43 for other sections which have the same vertex pair data of the section data as that of the read-out section and stores the names of the searched sections as adjacent sections along with the vertex pair data in a predetermined area of the RAM 43 at step S414. Vertex pair data dividing two adjacent section is referred to as border data hereinafter.

When the search for all the adjacent sections to every side of the section read out at step S410 is finished, the CPU 17 counts the number of the adjacent sections and determines if it is one at step S416. If it is one, the CPU 17 judges that the section read out at step S410 is an end section located at an end of the closed area E and sets an end section flag in the predetermined area in the RAM 43 at step S418.

As shown in the memory map of FIG. 7, the RAM 43 contains memory areas for storing adjacent section names, border data, a border data erase flag, a processed section flag, a fork section flag (explained below), and an end section flag for each section.

If it is determined that a given section has three or more adjacent sections at step S420, the CPU 17 decides that a column of sections branches out from another column of sections and the section read out at step S410 is a fork section from which a column of sections branches and for which the CPU 17 sets a fork section flag at step S422. If it is determined that a section has no adjacent section at step S424, standard data processing of single section embroidering is carried out at step S426 because there is no adjacent section. If a given section has two adjacent sections, the CPU 17 decides that the given section is an ordinary, non-fork section located between two other sections in a section column. The CPU 17 carries out the process from steps S410 to S426 on all the sections at steps S428 and S430. Therefore, when the closed area E is divided into sections by the section data as shown in FIG. 5, end section flags are set for the sections a, f, l, g, and q while fork section flags are set for the sections c and j as shown in FIG. 7.

Figure 8:
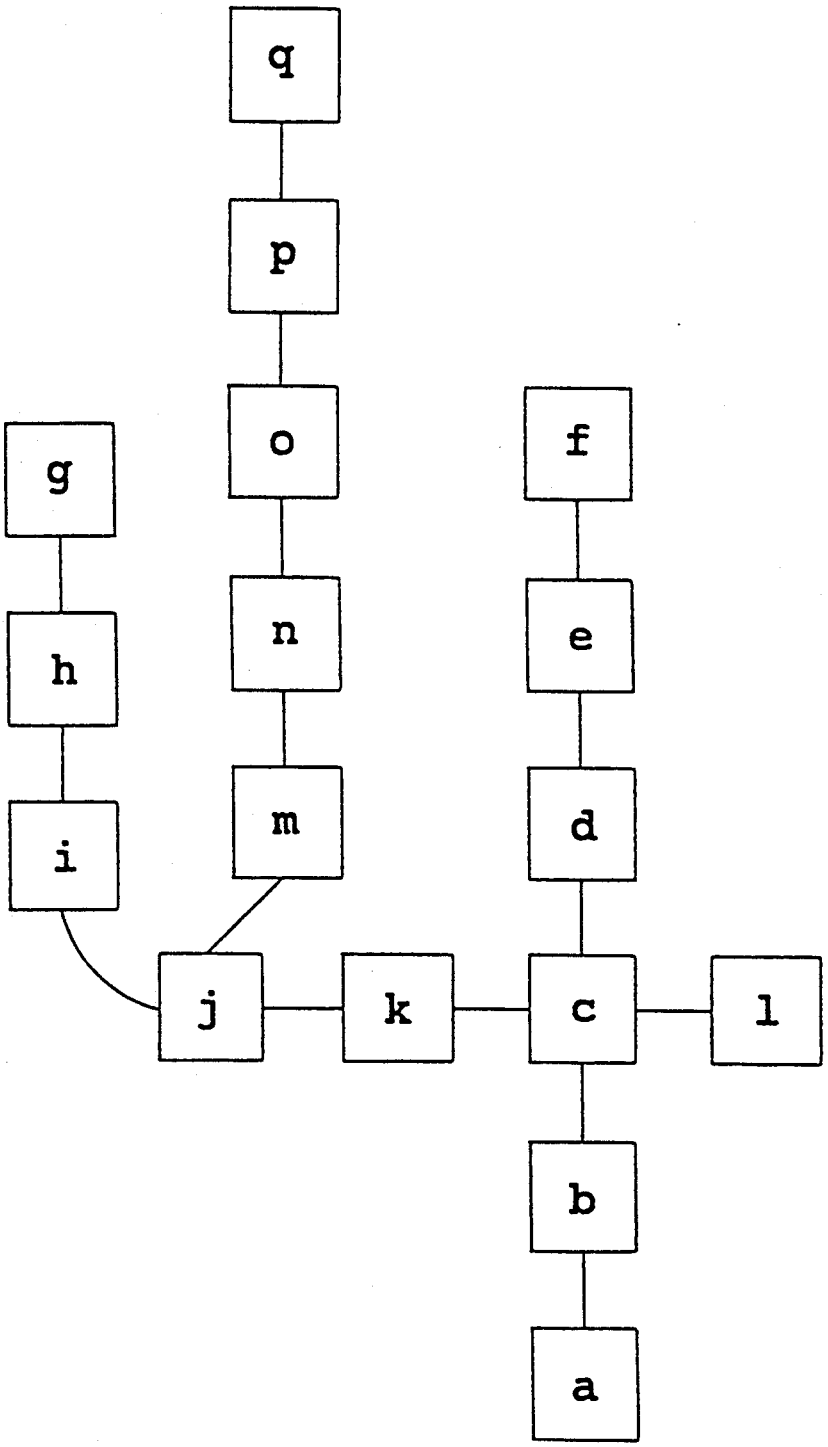
FIG. 8 is an explanatory view indicating the relative positions of the sections of the closed area E.
Figure 9:
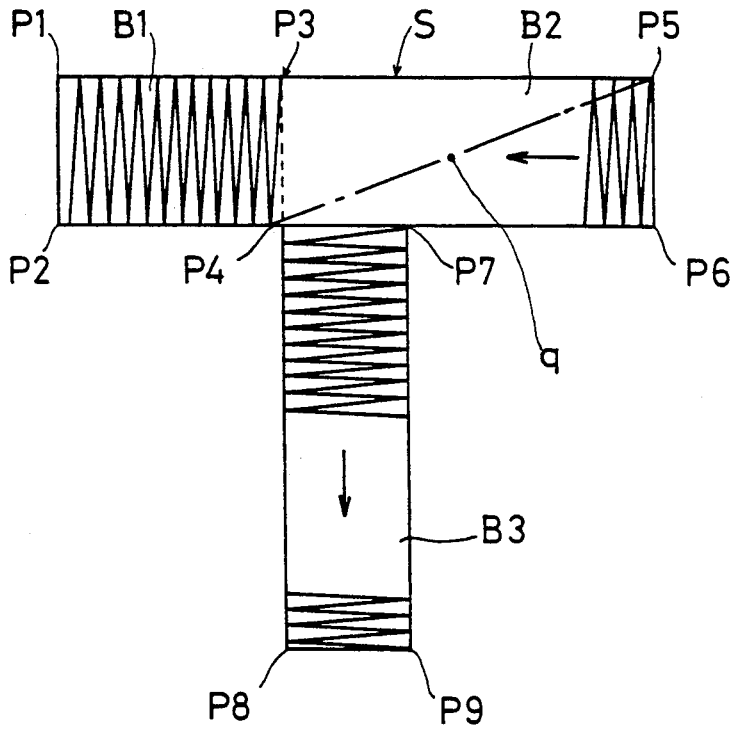
FIG. 9 PRIOR ART
FIG. 9 an explanatory view indicating manual sectioning of a character T and the processing of the running stitch data in the prior-art apparatus.

As shown in FIG. 8, the obtained adjacent section data represents the relative position of the sections. FIG. 8 shows the relative position of each section to the section a (a given section). A group of sections which share section data on starting sides or ending sides forms a section column. The section column stretching from the section a is a main section column which consists of the sections a–f. The sections a and f are called end sections of the main section column. A column of sections branching out of a main section column is called a branch section column. The section columns branching out from the main section column at the section c are branch section columns. The section c at which the two columns branch out is called a fork section. Another branch section column m-n-o-p-q branches out of the branch section column k-j-i-h-g at the section j. The sections l, g, and q are the end sections of the branch section column.

Next, the CPU 17 resets a fork section counter CNT at step S450, reads out the section data of the section a, which is the first section in the memory order, from the RAM 43, and stores the embroidering direction of the read-out section a at step S452.

If the CPU 17 determines that a read-out section is not an end section in a determination routine at step S454, that the read-out section is not a fork section in a determination routine at step S456, and that the value of the fork section counter CNT is zero in a determination routine at step S458, the CPU 17 stores the section data in an embroidery data area and sets a processed section flag for the section represented by the section data at step S460. At the same step, the CPU 17 sets an erase flag for the border data of the sections for which the processed section flag is set. Border data is expressed as vertex pair data. As an example, when a processed section flag is set for the section a, an erase flag is set for the border data consisting of points 3 and 4.

At step S460, before storing section data in the embroidery data area, the CPU 17 searches for an adjacent section whose section data has already been stored in the embroidery data area. If so, the CPU 17 determines if the ending side vertex pair data of the adjacent section are the same as the starting side vertex pair data of the read-out section. If not, the CPU 17 exchanges the starting side vertex pair data with the ending side vertex pair data before storing the data.

The CPU 17 now searches the adjacent sections to the sections which are stored at step S460 for the adjacent sections without a border data erase flag. Then, the CPU 17 reads out the section data of such adjacent sections and goes back to step S454 at step S462. If it is determined YES at step 454, the process steps go to step S470. If the section is the first section to be read-out, in other words, if no section data is stored in the embroidery area, the CPU 17 decides that the section is a starting section and the process steps go back to step S460 at step S470. If it is determined NO at step S470, the process steps go to step S472. If it is determined YES at step S456, in other words, if a section is a fork section, the CPU 17 stores the section data of the section in a temporary memory area BB [CNT] provided in the RAM 43 for temporarily storing such data as well as in a branch section column area and increments the fork section counter CNT and goes to step S462 at step S464.

Therefore, if a section read out at step S462 is neither an end section nor a fork section, it is determined NO at step S458 and the read-out section data is successively stored in the branch section column area provided in the RAM 43 at step S468 and the process then goes to step S462.

On the other hand, if the section according to the section data read out at step S462 is an end section, it is determined YES at step S454 and the CPU 17 goes to step S470. If the section is not a starting section which is the first section to be read out, it is determined NO at step S470. Then, it is determined if the section is the last section, in other words, if all the other sections have a processed section flag at step S472. If NO, the section data is stored in an end section area at step S474.

Now the CPU 17 successively reads out the section data from the branch section column area in the memory order, obtains the barycenter qi (i=0, 1, . . . ,n−1) of each section, and stores its location data and a needle location data flag in the embroidery data area at step S478.

After that, the CPU 17 reads out the section data from the end section area, obtains the barycenters qn, designates the top of the end section as a running stitch end r which is not designated as border data, and stores its location data and a needle location data flag in the embroidery data area at step S480. The running stitch end r is a vertex not stored as border data. The barycenters q0, q1, . . . ,qn and the running stitch end r compose a running stitch data which designates the route of running stitches running from a fork section to the top of an end section.

Next, the CPU 17 reads out the section data of the sections most recently stored in the temporary memory area BB [CNT] from the end section where the running stitch end r ends to the section which is adjacent to the fork section and is on the same side as the running stitch end r in the opposite direction to that of the running stitch r for embroidering the sections from the end section to the adjacent section in the opposite direction and also stores the above read-out section data of each section at step S482. The CPU 17 compares the embroidering direction of each section of the read-out sections with the above-defined opposite direction. If the two directions are not the same, the CPU 17 exchanges the starting side data of the section with the ending side data of the section.

When the end section to the section adjacent to the most recently stored fork section have been stored in the embroidery data area as explained above, processed section flags and border flags for border data represented by vertex data are set for the branch column sections as shown in the memory map of FIG. 7.

Meanwhile, the CPU 17 erases the section data of the sections stored in the branch section column area since the section data is stored in the embroidery data area and clears the end section area at step S484. Then, the CPU 17 again reads out the section data of the fork section most recently stored in the temporary memory area BB [CNT] at step S486 and determines if there is only one set of border data for which an erase flag is not set, among the border data of the adjacent sections to the most recently stored fork section at step S488. In other words, the CPU 17 determines if the remaining unprocessed part in the closed area will not be divided if the fork section is embroidered. If it is determined NO at this step, the embroidering of the fork section is judged impossible as it is. Then, the process steps go back to step S462 where the CPU 17 selects border data of one adjacent section for which an erase flag is not set, reads out from the RAM 43 the section data of the section having the vertexes represented by the border data, and repeats the process explained above.

On the other hand, if it is determined YES at step S488, the fork section is judged possible to embroider and the fork section data is stored in the embroidery data area at step S490. At this moment, the data processing of one adjacent section to either the starting side or the ending side of the fork section has been completed. The CPU 17 now determines if the embroidering direction of the adjacent section is the same as that of the fork section. If YES, the fork section data is stored in the embroidery data area. If NO, the CPU 17 exchanges the starting side data of the fork section with the ending side data of the fork section and stores the data in the embroidery data area. Meanwhile, a processed section flag and a border data erase flag are set.

Next, the CPU 17 decrements the fork section counter CNT at step S492 and goes back to step S462. At this step S462, the CPU 17 reads out a section which is adjacent to the fork section and for which a processed section flag is not set, and repeats the process from step S454.

When the section data of each section and the running stitch data is stored in the embroidery data area and the last section is read out at step S462, it is determined YES at step S454 and S472 and the CPU 17 stores the section data of the last section in the embroidery data area at step S494.

Likewise at this step, the section data is modified, if necessary, and stored so that the embroidering direction of the last section is the same as that of the second last section which is stored in the embroidery data area immediately before the last section.

After that, the CPU 17 waits for the embroidery start key 26 to be switched on at step S496. Upon switching on the embroidery start key 26, the process steps go to the embroidery routine at step S498 where an embroidery pattern is formed on the work W by moving the needle 5 and the support ring 14 by relative displacement based upon the section data and the running stitch data successively read out from the embroidery data area. During this operation, no cross threads occur.

After section data is read out, needle location data is computed based upon the stitch density data and the section data, as is well known in the art.

For clear understanding of the operation of the CPU 17, the process in which the sections a-q are stored for an embroidery is explained hereinafter.

The section data of the section a is read out at step S452 and is stored in the embroidery data area at step S460 after going through steps S454 and S470. Then, the section b is read out and stored in the embroidery data area because the value of the fork section counter CNT is zero. The section c, which is read out following the section b, is stored in the temporary memory area BB(0) and in the fork section column area after going through steps S456 and S464. At this point, the fork section counter CNT measures 1.

Next, one of the adjacent sections l, k, and d is read out. It is assumed for the sake of explanation that the section d is read out. The section data of the following sections d and e is successively stored in the fork section column area. When the section f is read out, the running stitch data for the running stitches running to the top of the end section is stored after going through steps S454 and S470–S480.

Then, section data of the sections f, e, and d are stored in the embroidery data area for embroidering the sections in the opposite direction to that of the running stitches.

As for the section c, it is determined NO at step S488 and the section l, for instance, is read out at step S462.

In this way, the section data is stored in the embroidery area with or without modification. The running stitch data is also stored as explained above.

While the described embodiment represent the preferred form of the invention, it is to be understood that changes and variations can be made without departing from the spirit and the scope of the invention.

For instance, the operator manually inputs the section data which is first stored in the memory means in the described embodiment. However, it is possible to detect the outline of an embroidery automatically after filming a drawing of the embroidery and automatically compute the section data based upon the outline data using an operational program.

Although running stitch data for running stitches comprises needle location data in the present embodiment, it could be expressed in a functional formula which expresses a running stitch route.

Running stitches are to run through the barycenter of each section in the present embodiment. They may, however, take any route as long as they run within the sections.

Also in the present embodiment, in order to perform embroidery from the top of an end section toward a fork section in the direction opposite to that of the running stitches, the embroidering direction of each section is compared with the opposite direction. If the embroidering direction and the opposite direction are the same, the section data of the section is stored in the embroidery data area. If not, the CPU exchanges the starting side data of the section with the ending side data of the section. During actual embroidering, the needle location data is computed based upon the predetermined stitch density and the section data which may or may not have been modified. The following is another method of embroidering the sections from the top of the running stitches toward the fork section in the opposite direction than the one in the present embodiment.

When the section data is read out by the read-out means, the needle location data is computed based upon the stitch density data and the read-out section data. At the same time, the embroidering direction is computed and temporarily stored. After the running stitch data is prepared, the direction opposite to that of the running stitches is compared with the computed embroidering direction of the needle location data in order to execute the embroidering of each section in the opposite direction. If the two directions are the same, the above needle location data is stored in the embroidery memory area in the same order as it has been processed. If not, the order of the above needle location data is reversed before it is stored in the embroidery memory area.

As described above in detail, according to the present invention, the memory means stores section data for the vertexes of polygonal sections dividing a closed area for embroidering the closed area and the read-out means successively reads out the section data corresponding to each of the given sections. Then, the determination means determines if a section corresponding to the section data read-out by the read-out means is an end section of the main section column connected with the given sections, a fork section from which a branch section column branches out of a main section column, or an end section of a branch section column based on the read-out section data. The running stitch computing means computes running stitch data representing the sewing route of running stitches which run from a fork section to the top of an end section of a branch section column or of a main section column prior to the embroidering of the fork section if a section corresponding to section data read out by the read-out means is a fork section. Subsequently, the needle location computing means computes needle location data for embroidering the sections in the opposite direction from the end of the running stitches toward the fork section based on the section data.

Due to the above composition of the present invention, if the section data is properly stored in the memory means, running stitches which run from the fork section to the top of the end section is automatically computed. Then, the needle location data for embroidering the sections in the opposite direction to that of the running stitches is automatically processed. Therefore, cross threads do not occur so that the operator does not have to consider embroidering order or the embroidering directions of stitches, or running stitches during data processing. Thus, the embroidery sewing processor of the present invention has the advantage that it saves time and allows even an unskilled operator to process embroidery sewing data easily.

What is claimed is:

1. An embroidery pattern data processor generating needle location data for a multi-needle embroidery sewing machine that sews embroidery patterns under control of the needle location data, the needle location data for an embroidery pattern being generated based on a plurality of sections formed by divided a closed area defined by an outline representing the embroidery pattern to be stitched by the sewing machine, comprising:

memory means for storing section data representing the plurality of sections of the embroidery pattern;

determination means for determining from the section data stored in the memory means whether each of the plurality of sections is an end section connected to only one other section, or a fork section connected to more than two other sections;

running stitch computing means for automatically computing running stitch needle location data for controlling the sewing machine to prevent cross threads and form running stitches along a running stitches route from each fork section to at least one end section prior to the embroidering of the fork sections; and needle location computing means for automatically computing embroidery needle location data for controlling the sewing machine to prevent cross-threads and form embroidery stitches along an embroidery route associated with each running stitches route from each end section where the running stitches routes end to the fork section where the running stitches routes begin.

2. The embroidery pattern data processor of claim 1, in which the sewing machine forms embroidery stitches along each embroidery route after the sewing machine finishes forming stitches along the associated running stitches route and before the sewing machine forms any other stitches.

3. The embroidery pattern data processor of claim 1, in which the sections are polygonal and the section data represents the vertexes of the polygonal sections.

4. The embroidery pattern data processor of claim 3, in which each running stitches route ends at one vertex of the end sections where the running stitches routes end and the embroidery routes associated with the running stitches routes begin at the vertexes where the running stitches routes end.

5. The embroidery pattern data processor of claim 4, in which all sections that are not end sections or fork sections are middle sections, where the running stitches routes and associated embroidery routes pass through the middle sections between the fork section where the running stitches routes begin and the end section where the running stitches routes end.

6. The embroidery pattern data processor of claim 5, in which each running stitches route begins at one vertex of the fork section where the running stitches routes begin and passes through a barycenter of each of the middle sections through which the running stitches routes pass.

7. An embroidery pattern data processor for generating needle location data for a multi-needle embroidery sewing machine that sews embroidery patterns under control of the needle location data, the needle location data for an embroidery pattern being generated based on a plurality of sections formed by dividing a closed area defined by an outline representing the embroidery pattern to be stitched by the sewing machine, comprising:

memory means for storing section data representing the plurality of sections of the embroidery pattern;

determination means for determining from the section data stored in the memory means each main section of a main section column, fork section from which at least one branch section column branches out from the main section column, and branch end section of a branch section column associated with each fork section;

running stitch computing means for automatically computing running stitch needle location data for controlling the sewing machine to prevent cross threads and form running stitches along each branch section column from each fork section to each associated branch end section prior to the embroidering of the fork sections; and needle location computing means for automatically computing embroidery needle location data from the section data to control the sewing machine to prevent cross threads and form embroidery stitches along each branch section column from each branch end section to the fork section from which the branch section column branches out.

8. The embroidery pattern data processor of claim 7, in which:

each main end section and each branch end section is connected to only one other section;

each fork section is connected to more than two other sections;

each branch section column is a series of adjacent sections that contains one branch end section and the sections between the branch end section in the branch section column and the fork section associated therewith; and the main section column is a series of adjacent sections that contains all sections not included in any branch section column.

9. The embroidery pattern data processor of claim 8, in which the needle location computing means computes needle location data such that the sewing machine sews the embroidery by beginning an embroidery stitch at one main end section and forming the embroidery stitch in a main sewing direction along the main section column.

10. The embroidery pattern data processor of claim 9, in which the sections are polygonal and the section data represents the vertexes of the polygonal sections.

11. The embroidery pattern data processor of claim 10, in which the running stitches along each branch section column end at one vertex of the branch end section associated with the branch section column and the embroidery stitches associated with each branch section column begin at the vertex where the running stitches end.

12. The embroidery pattern data processor of claim 11, in which all sections that are not end sections or fork sections are middle sections, where the running stitches and embroidery stitches for each branch section column pass through the middle sections between the fork sections and associated branch end sections.

13. The embroidery pattern data processor of claim 12, in which the running stitches begin at one vertex of the fork section associated with a branch section column and pass through a barycenter of each of the middle sections associated with the given branch section column.

14. A method of generating needle location data for a multi-needle embroidery sewing machine that sews embroidery patterns under control of the needle location data, the needle location data for an embroidery pattern being generated based on a plurality of sections formed by dividing a closed area defined by an outline representing the embroidery pattern to be stitched by the sewing machine, comprising the steps of:

determining from the section data whether each of the plurality of sections is an end section connected to only one other section, or a fork section connected to more than two other sections;

automatically computing running stitch needle location data for controlling the sewing machine to prevent cross threads and form running stitches along a running stitches route from each fork section to at least one end section prior to the embroidering of the fork sections; and automatically computing embroidery needle location data for controlling the sewing machine to prevent cross threads and form embroidery stitches along an embroidery route associated with each running stitches route from each end section where the running stitches routes end to the fork section where the running stitches routes begin.

15. The method of claim 14, in which the embroidery needle location data associated with each running stitches route is computed such that the sewing machine forms embroidery stitches along the embroidery routes associated with each of the running stitches routes after the sewing machine finishes forming stitches along the running stitches routes and before the sewing machine forms any other stitches.

16. The embroidery pattern data processor of claim 15, in which the sections are polygonal and the section data represents the vertexes of the polygonal sections.

17. The embroidery pattern data processor of claim 16, in which each running stitches route ends at one vertex of the end section where the running stitches routes end and the embroidery routes associated with the running stitches routes begin at the vertexes where the running stitches routes end.

18. The embroidery pattern data processor of claim 17, in which all sections that are not end sections or fork sections are determined to be middle sections, where each running stitches route and the embroidery route associated therewith pass through the middle sections between the fork section where the running stitches routes begin and the end section where the running stitches routes end.

19. The embroidery pattern data processor of claim 18, in which the running stitches routes begin at one vertex of the fork sections where the running stitches routes begin and passes through a barycenter of each of the middle sections through which the running stitches routes pass.

* * * * *